US011286651B2

(12) United States Patent
Rol Corredor et al.

(10) Patent No.: US 11,286,651 B2
(45) Date of Patent: Mar. 29, 2022

(54) FIXING MEANS FOR FIXING A WEAR ELEMENT ON THE FRONT EDGE OF A SUPPORT

(71) Applicant: METALOGENIA RESEARCH & TECHNOLOGIES S.L., Barcelona (ES)

(72) Inventors: Javier Rol Corredor, Sant Adrià del Besós (ES); Sergio Lopez Requejo, Mataró (ES); Angel Martinez Mane, Mataró (ES); Francisco Perez Soria, La Roca del Vallès (ES); Jorge Triginer Boixeda, Barcelona (ES); Carlos Amat Holgado, Premià de Dalt (ES)

(73) Assignee: METALOGENIA RESEARCH & TECHNOLOGIES S.L., Barcelona (ES)

( * ) Notice: Subject to any disclaimer, the term of this patent is extended or adjusted under 35 U.S.C. 154(b) by 30 days.

(21) Appl. No.: 16/772,431

(22) PCT Filed: Dec. 7, 2018

(86) PCT No.: PCT/EP2018/083945
§ 371 (c)(1),
(2) Date: Jun. 12, 2020

(87) PCT Pub. No.: WO2019/115379
PCT Pub. Date: Jun. 20, 2019

(65) Prior Publication Data

US 2021/0071396 A1 Mar. 11, 2021

(30) Foreign Application Priority Data

Dec. 13, 2017 (EP) ..... 17380027

(51) Int. Cl.
*E02F 9/28* (2006.01)

(52) U.S. Cl.
CPC ..... *E02F 9/2833* (2013.01)

(58) Field of Classification Search
CPC ..... E02F 9/2833
(Continued)

(56) References Cited

U.S. PATENT DOCUMENTS 3,722,932 A * 3/1973 Dougall ..... F16B 3/00 403/379.4
4,413,432 A * 11/1983 Bierwith ..... E02F 9/2825 37/456

(Continued)

FOREIGN PATENT DOCUMENTS

AU 716828 B2 3/2000
CA 2316712 A1 2/2001

OTHER PUBLICATIONS

International Search Report, PCT/EP2018/083945, dated Feb. 4, 2019.

*Primary Examiner* — Gary S Hartmann
(74) *Attorney, Agent, or Firm* — Porzio Bromberg & Newman P.C.

(57) ABSTRACT

A wear element configured to be fixed on a support, where the wear element comprises two arms wrapping around the front edge of the support. The wear element being fixed with [a] a C-shaped body, [b] a wedge, [c] a screw with a shank, with a first segment having a smaller diameter than the head, a second segment having a larger diameter than the first segment, and a threaded segment, and [d] a nut. The shank of the screw is housed between the wedge and the body. The C-shaped body has a C-shaped projection suitable for housing the first segment of the screw. The projection has substantially the same height as the first segment. Neither the head nor the second segment can go through the projection. The wedge has a first projection and a second projection. Both projections have through holes suitable for (Continued)

allowing the passage of the threaded segment and suitable for blocking the passage of the nut, and the distance between both projection is greater than the height of the nut.

5 Claims, 5 Drawing Sheets

(58) Field of Classification Search
USPC ..... 37/455, 456
See application file for complete search history.

(56) References Cited

U.S. PATENT DOCUMENTS

| | | | | | |
|---|---|---|---|---|---|
| 4,433,496 | A | | 2/1984 | Larren et al. | |
| 5,410,826 | A | * | 5/1995 | Immel | E02F 9/2833 37/455 |
| 5,868,518 | A | * | 2/1999 | Chesterfield | E02F 3/36 403/379.4 |
| 5,964,547 | A | * | 10/1999 | Brinkley | E02F 9/2825 403/374.3 |
| 6,009,644 | A | * | 1/2000 | Hedley | E02F 9/2833 37/456 |
| 6,301,810 | B1 | * | 10/2001 | Fidler | E02F 9/2825 37/455 |
| 7,516,564 | B2 | * | 4/2009 | Ruvang | E02F 9/2833 37/456 |
| 8,898,937 | B2 | * | 12/2014 | Campomanes | E02F 9/2825 37/456 |
| 9,200,433 | B2 | * | 12/2015 | Tasovski | E02F 9/2825 |
| 9,353,505 | B2 | * | 5/2016 | Pilon | E02F 9/2883 |
| 9,932,723 | B2 | * | 4/2018 | Triginer Boixeda | E02F 9/2883 |
| 2015/0096207 | A1 | | 4/2015 | Tasovski | |
| 2020/0291621 | A1 | * | 9/2020 | Rol Corr Dor | E02F 9/2841 |

* cited by examiner

FIXING MEANS FOR FIXING A WEAR ELEMENT ON THE FRONT EDGE OF A SUPPORT

FIELD OF THE INVENTION

The invention relates to fixing means for fixing a wear element on the front edge of a support. The wear element comprises two arms extending backwards opposite one another, leaving a gap therebetween to house the front edge of the support, thereby defining an assembled position. The arms have first through holes facing one another and the support has a second through hole which is sandwiched between the first through holes in the assembled position. The fixing means comprise: [a] a C-shaped body, [b] a wedge, where the body and the wedge are housed in the holes in the assembled position, and [c] a screw having a head and a shank, with a first segment under the head having a smaller diameter than the head, a second segment after the first segment having a larger diameter than the first segment, and a threaded segment after the second segment, where the first segment has a length of a predetermined value (a certain value L1) in the axial direction, where there is a hollow space between the wedge and the body in the assembled position suitable for housing the shank of the screw, this hollow space defining a shank axis coinciding with the shaft of the shank.

STATE OF THE ART

It is common for earth moving machines to use wear elements, for example such as teeth or assemblies of a tooth plus an adaptor, on the lips of buckets. These wear elements have a limited service life, and are furthermore prone to experiencing breakages, so it is common to have to replace them many times. As a result, a plurality of fixing systems for fixing same has been developed. In smaller-sized machines, it is common for adaptors to be welded to the lip (also referred to as blade) of the bucket, but in larger-sized machines (for example, those used in mining), it is common for the adaptors to be mechanically fixed to the lip in a reversible manner.

In order to mechanically fix adapters, two families of fixing means are commonly used. A first family basically consists of a two-piece assembly: a C-shaped first body (normally referred to as a C-clamp) and a wedge, whereas the second family basically consists of three parts: a C-shaped first body, a wedge and a second body (normally also referred to as a counter wedge). In both cases, there are normally two variants: the wedge is inserted into one of them by means of a hammer or the like, whereas in the other variant the fixing means also include a screw or the like which allows inserting the wedge into its fixing position when screwed into a threaded element fixed to one of the other elements Patent document WO 00/20696 shows (see FIGS. 7 to 10, for example) fixing means like the ones indicated above. The C-shaped body has a projection extending into the hollow space. This projection has a threaded through hole into which the end of the screw is screwed. In turn, the wedge has another C-shaped projection suitable for housing the first segment of the screw. When the screw is turned, it can be moved in the axial direction with respect to the C-shaped body and can take the wedge with it through the C-shaped projection.

However, there is still a need to improve these fixing means. They must work under very demanding work conditions, and they must be resistant and reliable both in the sense that they assure a reliable fixing and in the sense that they assure a reliable disassembly, even after having been subjected to the aforementioned work conditions.

Furthermore, particularly concerning the fixing means described in WO 00/20696, there is a need to protect the threading of the screw against impacts received by the wedge. During usage, the threading of the screw (and/or of the threaded hole) often sustains damage (deformations, elongations, etc.) which later make it difficult to disassemble the adapter.

DESCRIPTION OF THE INVENTION

The object of the invention is to overcome these drawbacks. This is achieved by fixing means of the type indicated above, characterized in that they additionally comprise [d] a nut screwed onto the threaded segment which preferably has an outer lateral perimeter greater than the outer lateral perimeter of the head, and in that:

- the C-shaped body has a C-shaped projection extending into the hollow space suitable for housing the first segment of the screw, where the length of the projection in the axial direction is less or equal than the predetermined value for the length of the first segment (the value "L1"), and where neither the head nor the second segment is suitable for moving through the projection in the axial direction, i.e., the cross-section of the space between the arms of the projection is smaller than the cross-section of the head and of the second segment,
- the wedge has a first projection and a second projection extending into the hollow space, where the first projection has a through hole suitable for allowing the passage of the threaded segment and suitable for blocking the passage of the nut, and where the second projection has a through hole suitable for allowing the passage of the threaded segment and suitable for blocking the passage of the nut, where the nut is allocated between the first projection and the second projection in the assembled position (the thread is able to move from the first projection to the second projection and vice versa when rotating the screw in one or the opposite sense), and where the distance between the first projection and the second projection in the axial direction is greater than the height of the nut in the axial direction.

In fact, the fixing means isolate the threading of the screw and the nut from possible impacts received by the wedge. When the wedge receives an impact, it will move downwards, but given that the nut is not fixed to the wedge, the threading of the screw and nut are protected and do not sustain any deformation. The distance between the first projection and the second projection in the axial direction must be greater than the height of the nut to assure that the nut does not receive external impacts. However, when receiving an external impact, the wedge will always sustain a downward movement (due to elastic and/or plastic deformation of the materials), so the distance between both projections must also take this possible movement into account, such that the distance must be greater than the sum of the height of the nut and the expected movement. This movement (or an approximate value thereof) can be determined during the design stage of the fixing means, so a previously established value "D" defining the maximum expected movement can be determined. In this case, the distance between the first projection and the second projection must be greater than the sum of the height of the nut and the previously established value "D".

Additionally, the means according to the invention have the additional advantage that they are "self-adjusting" during usage. In fact, wear is generated during usage due to erosion and abrasion in the area of contact between the adapter and the lip of the bucket. This allows the adapter to be able to move backwards. With the means according to the invention, when the adapter moves backwards, the wedge can drop down (since it is not attached to the nut) by again tightening the adapter. To that end, it is necessary to envisage during the design stage the value that the downward movement of the wedge may have due to this wear, and this value will also be taken into account when determining the value "D" indicated above. The distance between the first projection and the second projection in the axial direction is therefore preferably greater than the sum of the height of the nut in the axial direction and a previously established value "D". The distance between both projections is therefore enough to absorb the movement of the wedge during usage without the first projection or the second projection coming into contact with the nut.

The through holes of the first projection and of the second projection are preferably both laterally open holes, i.e., they are actually C-shaped projections, and the C-shaped projection of the C-shaped body is very preferably smaller than the laterally open through hole of the first projection in the transverse direction, such that the C-shaped projection of the C-shaped body is suitable for being housed inside the laterally open through hole of the first projection. As will be seen below, this allows implementing a particularly quick and simple assembly sequence for assembling the fixing means.

The wedge advantageously has in its front upper portion a rib suitable for abutting with the upper end of the front edge of the second hole. This purpose of this rib is to limit the downward movement of the wedge during usage, and it therefore clearly allows limiting the value "D" indicated above.

The wedge preferably has a transverse slot adjacent to the surface of the first projection which is opposite the nut and a transverse slot adjacent to the surface of the second projection which is opposite the nut. It can thereby be assured that the nut will have a completely planar support surface at both ends of its path of travel.

BRIEF DESCRIPTION OF THE DRAWINGS

Other advantages and features of the invention can be seen from the following description in which a preferred embodiment of the invention is described in a non-limiting manner in reference to the attached drawings. In said drawings.

DETAILED DESCRIPTION OF AN EMBODIMENT OF THE INVENTION

Figure 1:
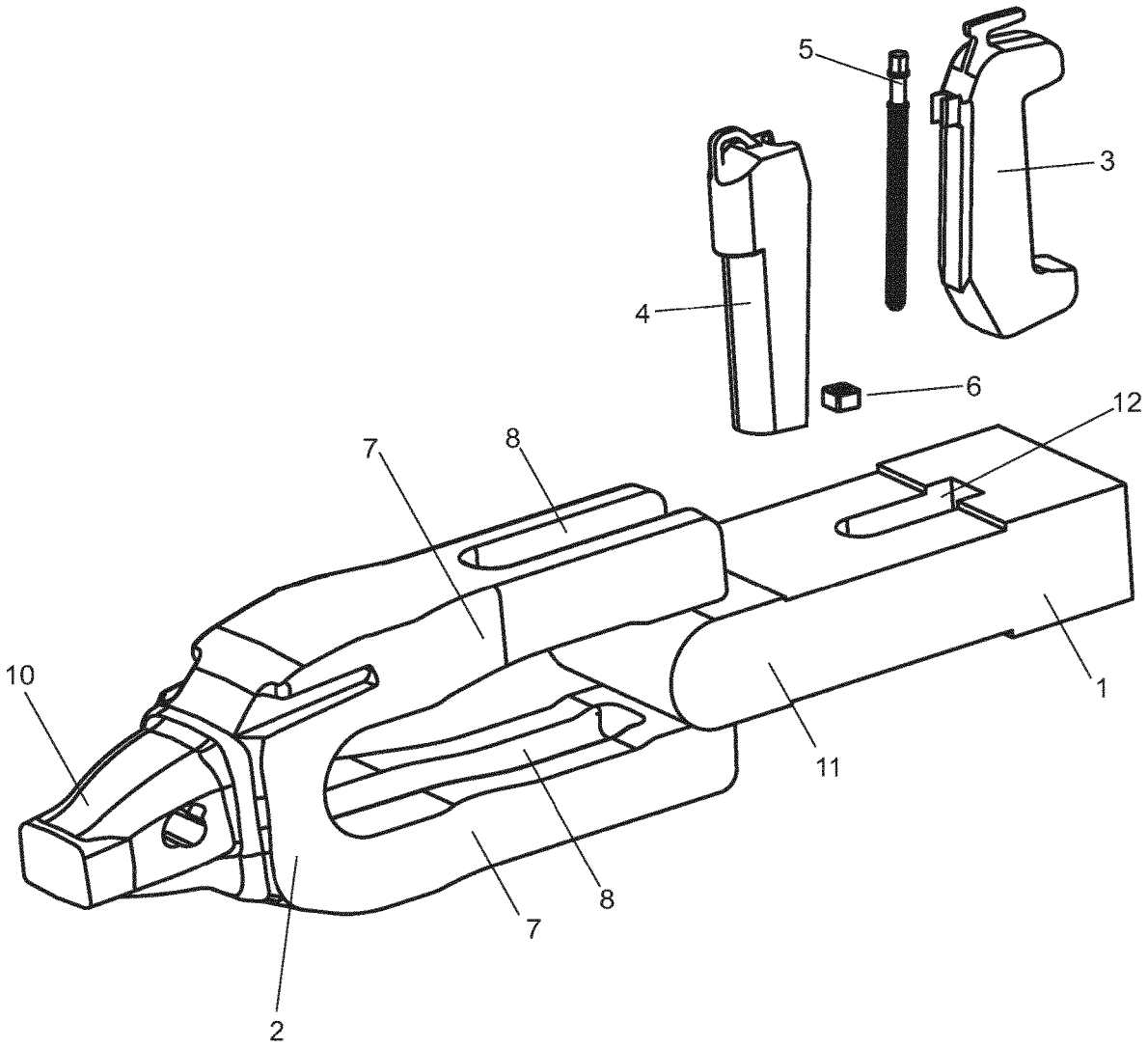
FIG. 1 shows an exploded perspective view of a lip of a bucket (partial), an adapter and fixing means according to the invention.

FIGS. 1 to 4 depict the assembly of a support 1 (the lip of a bucket of an excavator that is only partially depicted), a wear element 2 (an adapter 2) and fixing means according to the invention, comprising a C-shaped body 3, a wedge 4, a screw 5 and a nut 6.

The adapter 2 comprises two arms 7 extending backwards opposite one another, leaving a gap therebetween. Each of them has a first hole 8, which is opposite the first hole 8 of the other arm 7. There are housings 9 next to the rear end of the first holes 8 to house the free ends of the C-shaped body 3. A tooth, not depicted in the drawings, will be assembled at the front end 10 of the support 1.

The front edge 11 of the support 1 is housed between the two arms 7. The support 1 has on its front edge 11 (or close to it) a second hole 12 that is sandwiched between the first holes 8 of the arms 7 when the support 1 is in its assembled position.

The C-shaped body 3 and the wedge 4 are both housed in the holes 8 and 12 in the assembled position. In the assembled position, the ends of the C shape of the C-shaped body 3 are oriented backwards and housed in the housings 9. The wedge 4 is in front of the body 3 and is in contact with the body 3 and the front edge of the second hole 12.

There is a hollow space 13 between the wedge 4 and the body 3 suitable for housing the shank of the screw 5. The hollow space 13 defines a shank axis coinciding with the shaft of the shank of the screw 5. The screw 5 (also see FIGS. 4 to 8) has a head 14 and a shank with a first segment 15 under the head 14 having a smaller diameter than the head 14 (the head 14 is not actually cylindrical (in this example it is hexagonal), so it must be understood that the first segment has a diameter that is smaller than the diameter circumscribing the head 14), a second segment 16 after the first segment 15 having a larger diameter than the first segment 15, and a threaded segment 17 after the second segment 16, with a nut 6 screwed onto it. The nut 6 preferably has a square outer perimeter, since rotation thereof is prevented when it is inserted into the hollow space 13, having a rectangular cross-section. However, it would be possible to provide the nut with any one outer perimeter that is not circular (for example, hexagonal, elliptical, etc.) since by accordingly configuring the hollow space, rotation of the nut when the screw is rotated can also be prevented. The first segment 15 has a length in the axial direction of value L1.

The body 3 has a C-shaped projection 18 extending into the hollow space 13 suitable for housing the first segment 15 of the screw 5. The length of the projection 18 in the axial direction is also of value L1 (or slightly less than L1). In the present description and claims, when it is said that the length of the projection 18 is equal than the length of the first segment 15 it has to be understood in the following way: the gap (in axial direction) between both elements has to be big enough in order to assure that, considering the normal dispersions in the manufacturing of these kinds of parts, there will not be a significant friction that hampers the free rotation of the screw but is not bigger than necessary for achieving this "frictionless" rotation. The screw 5 can thereby be blocked in the axial direction, and when the screw 5 is rotated, the relative position between the screw 5 and the body 3 does not change since they are both integral in the axial direction. The first segment 15 has a diameter smaller than the head 14 and the second segment 16, so the inner diameter of the projection 18 is also smaller than the outer diameter of the head 14 and the second segment 16. Therefore, neither the head 14 nor the second segment 16 is suitable for moving through the projection 18 in the axial direction.

The wedge 4 has a first projection 19 and a second projection 20 extending into the hollow space 13, arranged (in the assembled position) below (in the axial direction) the projection 18 of the body 3. The first projection 19 has a through hole 21 suitable for allowing the passage of the threaded segment 17 and suitable for blocking the passage of the nut 6. The second projection 20 also has a through hole 22 suitable for allowing the passage of the threaded segment 17 and suitable for blocking the passage of the nut 6, where the distance between the first projection 19 and the second projection 20 in the axial direction is greater than the height of the nut 6 in the axial direction.

In general, both the through hole 21 of the first projection 19 and the through hole 22 of the second projection 20 are preferably laterally open holes, i.e., they are actually C-shaped projections.

Figure 8:
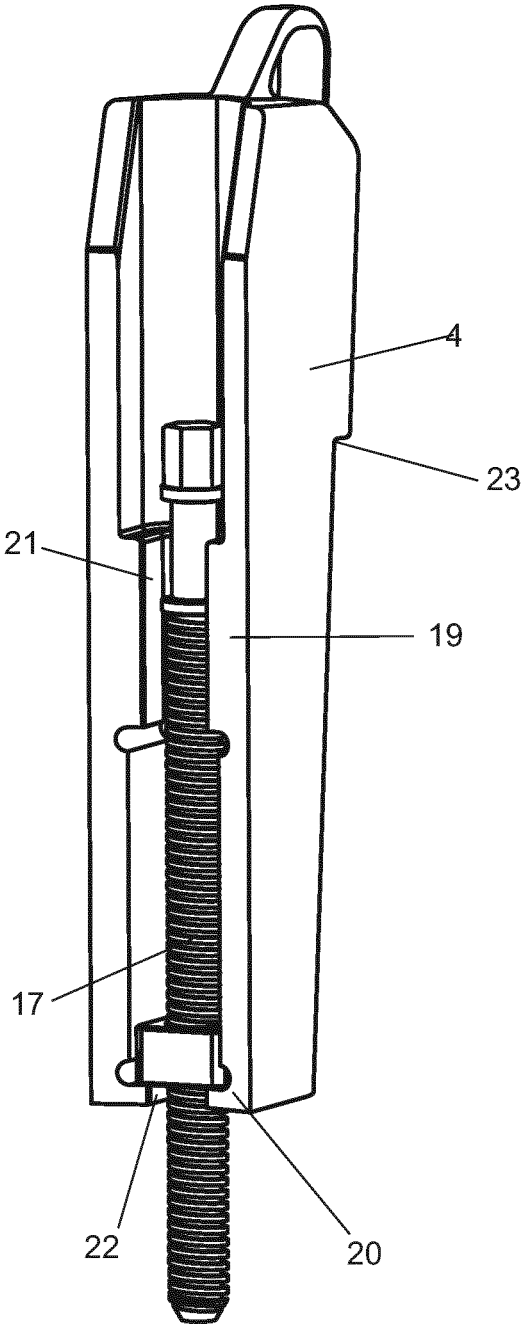

Furthermore, as can be seen in FIG. 8, side walls partially surrounding the threaded segment 17 can extend between the first projection 19 and the second projection 20.

Figure 9:
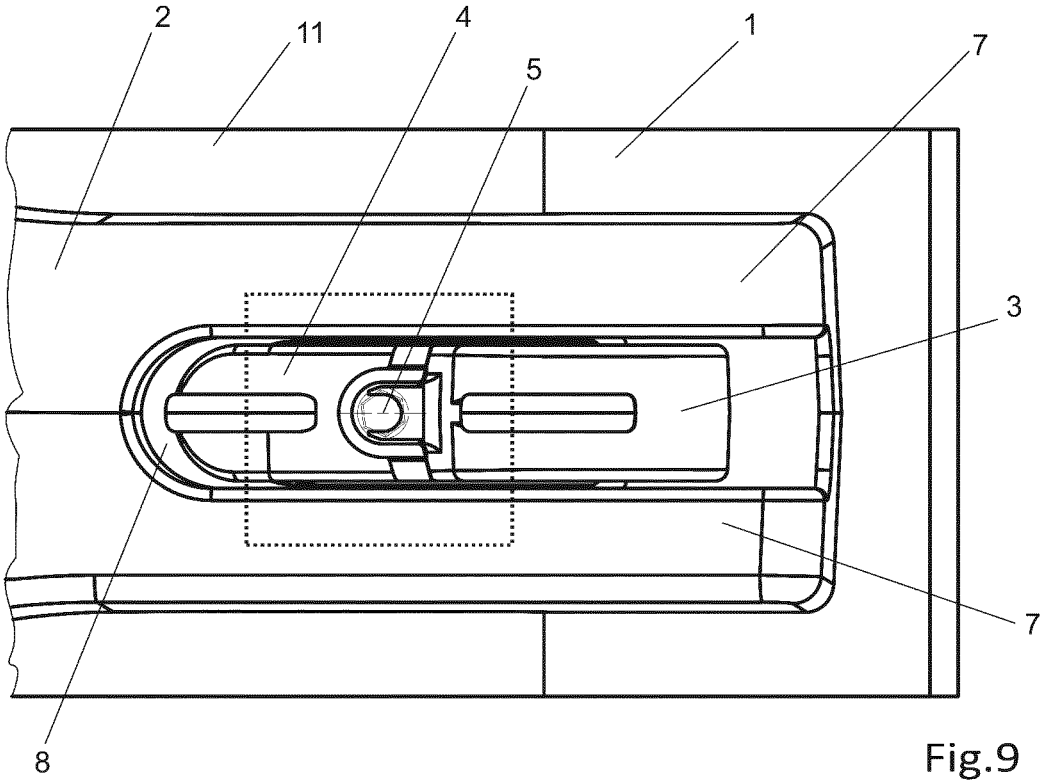
FIG. 9 shows a top plan view of the assembly of FIG. 2.
Figure 10:
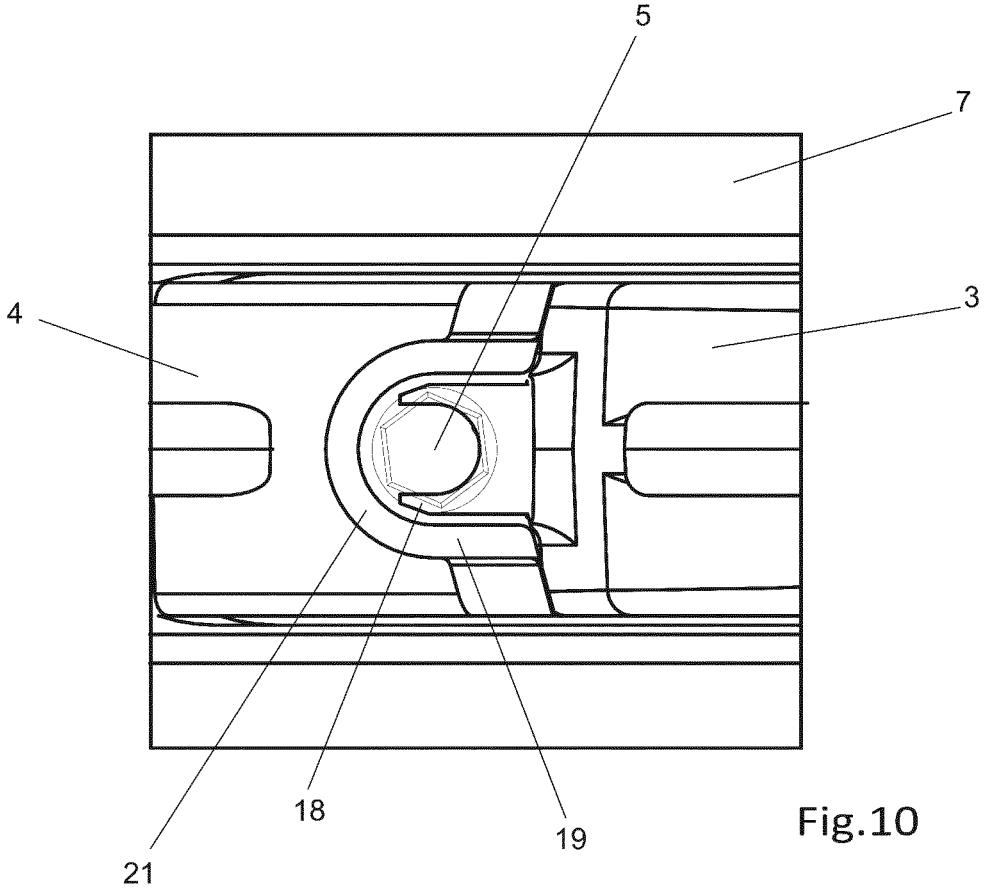
FIG. 10 shows an enlargement of the central portion of FIG. 9.

The position of the projection 18 of the body 3, the first projection 19 of the wedge 4 and the head 14 of the screw 5 in the assembled position are shown in greater detail in FIGS. 9 and 10. In these figures, the head 14 of the screw 5 has been depicted as if it were transparent to allow seeing in greater detail what is underneath it. The body 3 and the wedge 4 are next to one another, and the first projection 19 of the wedge 4 has its laterally open (i.e., C-shaped) through hole 21 with dimensions such that they allow the projection 18 of the body 3 to move inside it. It also allows the screw 5 (including its head 14) to move inside it. So when assembling the assembly, the screw 5 can be assembled in the projection 18 of the body 3, and then the wedge 4 can be slid above body 3 until it is retained by the nut 6, which has larger dimensions than the head 14 of the screw 5.

Figure 2:
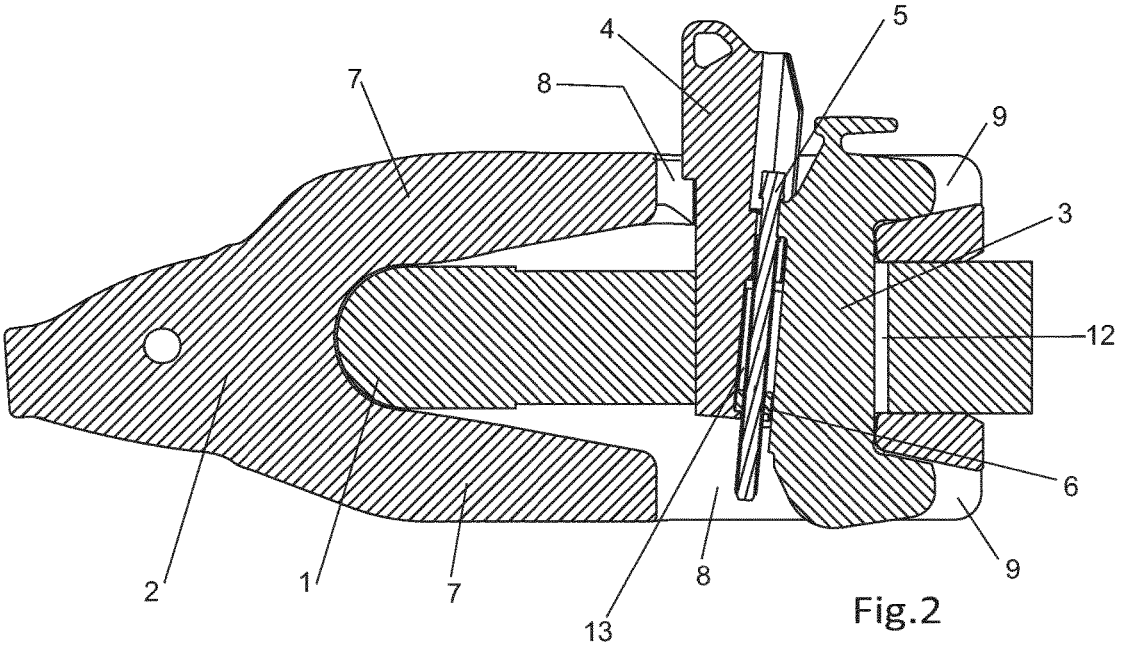
FIG. 2 shows a view of a longitudinal section of the lip of bucket, adapter and fixing means of FIG. 1 in the assembled position.

The assembly sequence is the following (not all the steps have to exactly follow the order indicated below):

the adapter 2 is assembled on the support 1 until the holes 8 and 12 coincide, the body 3 is inserted into the holes 8 and 12 and moved backwards until the ends of the C are housed in the housings 9, the screw 5 is positioned in the projection 18 of the body 3, such that the first segment 15 is housed inside the projection 18, the nut 6 is screwed on up to an intermediate point of the threaded segment 17, the wedge 4 is inserted into the holes 8 and 12 and positioned such that the nut 6 is located between the first projection 19 and the second projection 20 of the wedge 4, specifically the nut 6 is located adjacent to the first projection 19, inside the space 13, so that the wedge 4 and the second projection 20 can enter the holes 8 and 12, the screw 5 is rotated such that the nut 6 moves downwards until it touches the second projection 20 of the wedge 4, where as a result of the transverse slot 25 adjacent to the surface of the second projection 20, it finds a planar surface that allows it to provide suitable support, the screw 5 continues to be rotated so that the nut 6 continues to move downwards, which causes a downward pulling of the wedge 4 until it reaches the assembled position, shown in FIG. 2.

Figure 3:
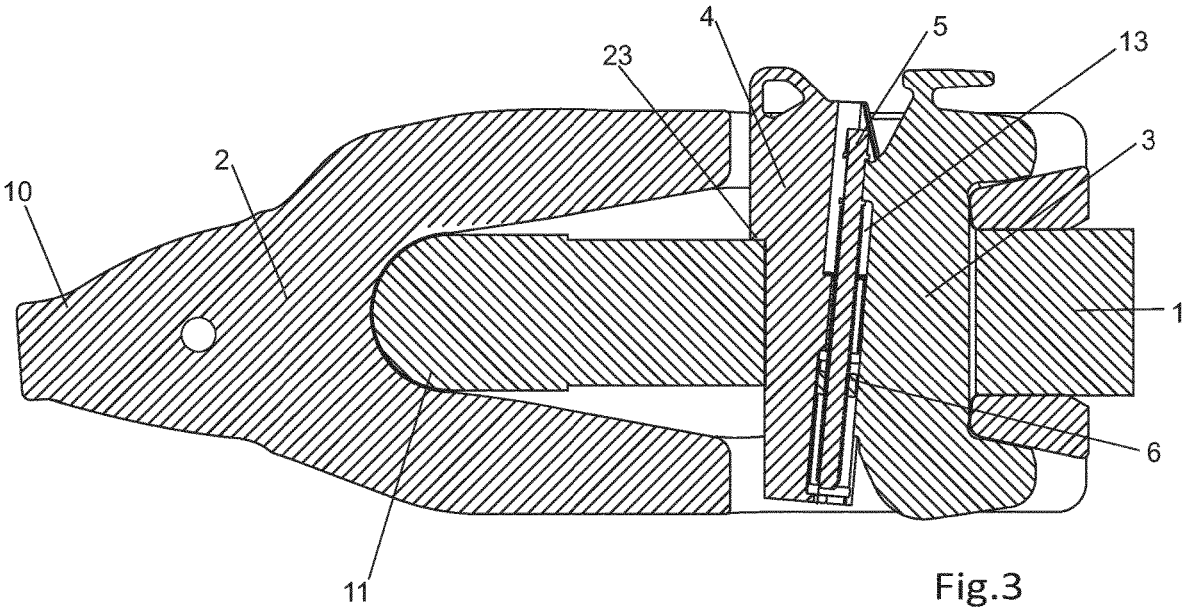
FIG. 3 shows a view of a longitudinal section of the assembly of FIG. 2 in a position prior to disassembly.
Figure 4:
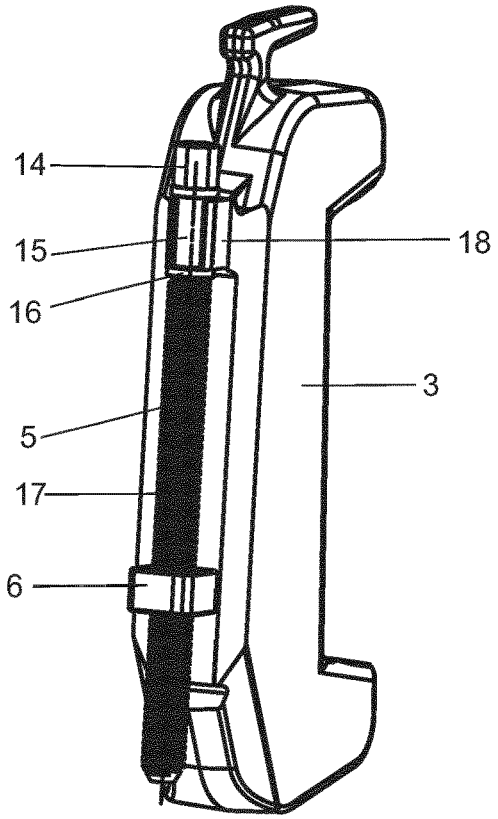
FIGS. 4 to 6 show a perspective, front and side view, respectively, of the C-shaped body and the screw of FIG. 1 in the assembled position.
Figure 5:
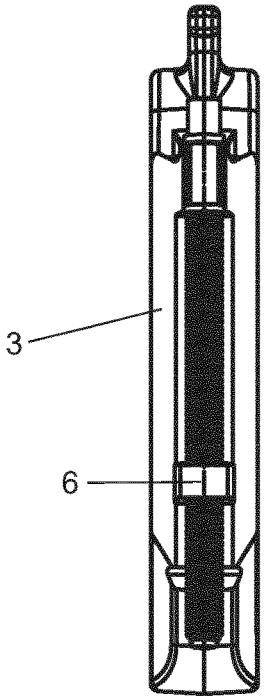
Figure 6:
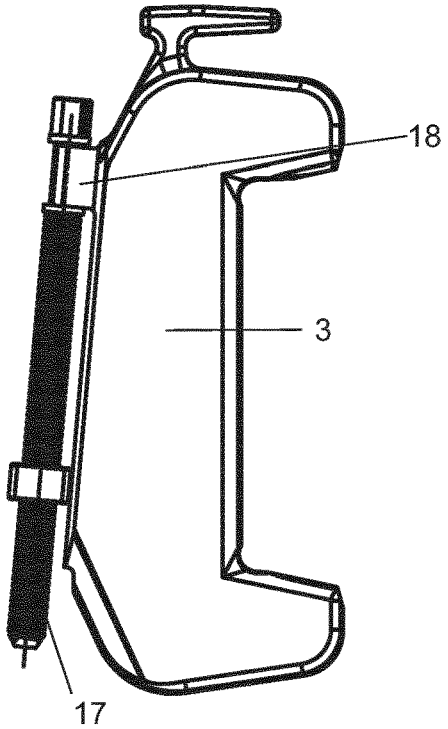
Figure 7:
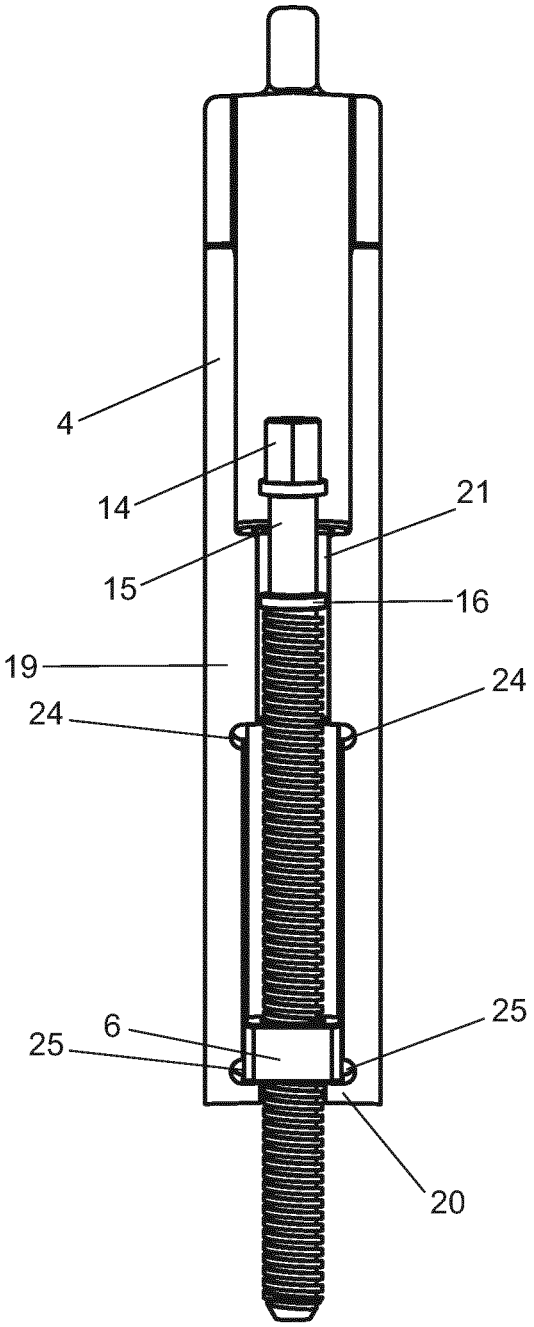
FIGS. 7 and 8 show a front and perspective view, respectively, of the wedge and the screw of FIG. 1 in the assembled position.

During usage, the wedge 4 may sustain downward and horizontal impacts. However, since the threaded segment 17 of the screw 5 and the nut 6 are completely independent of the wedge 4, they do not sustain the effect of these impacts, so the corresponding threadings do not deteriorate. Additionally, the wedge 4 can move downwards (due to gravity, and especially due to being impacted by the material passing over the wedge 4) if there is a clearance between the adapter 2 and the support 1 due to wear of the adapter 2 (and/or the support 1). This downward movement may take place until the rib 23 comes into contact with the upper end of the front edge of the second hole 12 (as shown in FIG. 3). At this time, the wedge 4 will no longer move further downwards, so the risk of the wedge 4 ultimately being supported on the nut 6, through the first projection 19, is prevented, in which case a downwards impact on the wedge 4 could damage the threading of the screw 5 or the nut 6.

To disassemble the fixing means, the screw 5 is rotated in the opposite direction, such that the nut 6 moves upwards until abutting with the first projection 19 of the wedge 4, where as a result of the transverse slot 24 adjacent to the surface of the first projection 20, it again finds a planar surface that allows it to provide suitable support. If the screw 5 continues to be rotated, the nut 6 will pull the wedge 4 upwards, thereby allowing it to be removed.

The invention claimed is:

1. Fixing means for fixing a wear element on the front edge of a support, where said wear element comprises two arms extending backwards opposite one another, the two arms having a gap therebetween configured to house said front edge in an assembled position, where each of said arms having a first through hole, the first through hole of each of said arms of facing one another and said support has a second through hole which is sandwiched between said the first through hole of each of said arms in said assembled position, where said fixing means comprise: [a] a C-shaped body, [b] a wedge, where said body and said wedge are housed in said holes in said assembled position, and [c] a screw having a head and a shank, with a first segment under said head having a smaller diameter than said head, a second segment after said first segment having a larger diameter than said first segment, and a threaded segment after said second segment, where said first segment has a predetermined length in the axial direction, where there is a hollow space between said wedge and said body in said assembled position suitable for housing the shank of said screw, said hollow space defining a shank axis coinciding with the shaft of said shank, a nut screwed onto said threaded segment, wherein said C-shaped body has a C-shaped projection extending into said hollow space suitable for housing said first segment of said screw, where a length of said projection in the axial direction is less or equal than said predetermined length, and where neither said head nor said second segment is suitable for moving through said projection in the axial direction, said wedge has a first projection and a second projection extending into said hollow space, where said first projection has a through hole suitable for receiving said threaded segment and suitable for blocking the passage of said nut, and where said second projection has a through hole suitable for receiving said threaded segment and suitable for blocking the passage of said nut, where said nut is located between said first projection and said second projection in said assembled position, and where a distance between said first projection and said second projection in the axial direction is greater than a height of said nut in the axial direction.

2. The fixing means according to claim 1, wherein said through hole of said first projection and said through hole of said second projection are both laterally open holes.

3. The fixing means according to claim 2, wherein said C-shaped projection of said C-shaped body is smaller than said laterally open through hole of said first projection in the transverse direction, such that said C-shaped projection of said C-shaped body is suitable for being housed inside said laterally open through hole of said first projection.

4. The fixing means according to claim 1, wherein a front upper portion of said wedge has a rib suitable for abutting with an upper end of a front edge of said second through hole.

5. The fixing means according to claim 1, wherein said wedge has a transverse slot adjacent to a surface of said first projection which is opposite said nut, and a transverse slot adjacent to a surface of said second projection which is opposite said nut.

* * * * *